US011697887B2

(12) United States Patent
Zimmerman et al.

(10) Patent No.: US 11,697,887 B2
(45) Date of Patent: Jul. 11, 2023

(54) MULTI-COMPARTMENT ELECTROCHEMICAL REPLENISHMENT CELL

(71) Applicant: Applied Materials, Inc., Santa Clara, CA (US)

(72) Inventors: Nolan L. Zimmerman, Kalispell, MT (US); Charles Sharbono, Whitefish, MT (US); Gregory J. Wilson, Kalispell, MT (US); Paul R. McHugh, Kalispell, MT (US); Paul Van Valkenburg, Whitefish, MT (US); Deepak Saagar Kalaikadal, Kalispell, MT (US); Kyle M. Hanson, Kalispell, MT (US)

(73) Assignee: Applied Materials, Inc., Santa Clara, CA (US)

( * ) Notice: Subject to any disclaimer, the term of this patent is extended or adjusted under 35 U.S.C. 154(b) by 27 days.

(21) Appl. No.: 17/078,413

(22) Filed: Oct. 23, 2020

(65) Prior Publication Data

US 2022/0127747 A1 Apr. 28, 2022

(51) Int. Cl.
*C25D 17/10* (2006.01)
*C25D 21/12* (2006.01)
(Continued)

(52) U.S. Cl.
CPC ..... *C25D 17/10* (2013.01); *C25D 7/123* (2013.01); *C25D 17/001* (2013.01);
(Continued)

(58) Field of Classification Search
CPC .. C25D 21/14; C25D 21/18; C25D 7/12–123; C25D 17/001; C25D 17/002; H01L 21/2885; H01L 21/76873
See application file for complete search history.

(56) References Cited

U.S. PATENT DOCUMENTS 6,569,299 B1 5/2003 Reid et al.
2012/0100287 A1* 4/2012 Wong ..... C25D 5/08 427/127

(Continued)

FOREIGN PATENT DOCUMENTS

CN 205954137 U 2/2017
KR 1020090060903 A * 6/2009

(Continued)

OTHER PUBLICATIONS

Catonne et al., Original and Machine Translation, CA 2021242 A1 (Year: 1991).*

(Continued)

*Primary Examiner* — Hosung Chung
(74) *Attorney, Agent, or Firm* — Kilpatrick Townsend & Stockton LLP

(57) ABSTRACT

Electroplating systems may include an electroplating chamber. The systems may also include a replenish assembly fluidly coupled with the electroplating chamber. The replenish assembly may include a first compartment housing anode material. The first compartment may include a first compartment section in which the anode material is housed and a second compartment section separated from the first compartment section by a divider. The replenish assembly may include a second compartment fluidly coupled with the electroplating chamber and electrically coupled with the first compartment. The replenish assembly may also include a third compartment electrically coupled with the second compartment, the third compartment including an inert cathode.

20 Claims, 7 Drawing Sheets

(51) Int. Cl.
*C25D 21/18* (2006.01)
*C25D 7/12* (2006.01)
*C25D 17/00* (2006.01)

(52) U.S. Cl.
CPC ..... *C25D 17/002* (2013.01); *C25D 21/12* (2013.01); *C25D 21/18* (2013.01)

(56) References Cited

U.S. PATENT DOCUMENTS

| | | | | |
|---|---|---|---|---|
| 2014/0332393 | A1 | 11/2014 | Shimoyama et al. | |
| 2014/0360865 | A1* | 12/2014 | Kimura | C25D 17/002 204/198 |
| 2017/0016137 | A1* | 1/2017 | Wilson | C25D 17/002 |
| 2017/0298532 | A1 | 10/2017 | Buckalew | |
| 2019/0003067 | A1* | 1/2019 | Aronsson | C25D 5/623 |

FOREIGN PATENT DOCUMENTS

| | | | |
|---|---|---|---|
| KR | 2011-0027585 | A | 3/2011 |
| TW | 201500598 | A | 1/2015 |
| TW | M540871 | U | 5/2017 |
| TW | 201718953 | A | 6/2017 |

OTHER PUBLICATIONS

International Search Report and Written Opinion dated Jan. 27, 2022 in International Patent Application No. PCT/US2021/055479, 10 pages.

* cited by examiner

MULTI-COMPARTMENT ELECTROCHEMICAL REPLENISHMENT CELL

TECHNICAL FIELD

The present technology relates to electroplating operations in semiconductor processing. More specifically, the present technology relates to systems and methods that perform ion replenishment for electroplating systems.

BACKGROUND

Integrated circuits are made possible by processes which produce intricately patterned material layers on substrate surfaces. After formation, etching, and other processing on a substrate, metal or other conductive materials are often deposited or formed to provide the electrical connections between components. Because this metallization may be performed after many manufacturing operations, problems occurring during the metallization may create expensive waste substrates or wafers.

Electroplating is performed in an electroplating chamber with the device side of the wafer in a bath of liquid electrolyte, and with electrical contacts on a contact ring touching a conductive layer on the wafer surface. Electrical current is passed through the electrolyte and the conductive layer. Metal ions in the electrolyte plate out onto the wafer, creating a metal layer on the wafer. Electroplating chambers typically have consumable anodes, which are beneficial for bath stability and cost of ownership. For example, it is common to use copper consumable anodes when plating copper. The copper ions taken out of the plating bath are replenished by the copper removed from the anodes, thereby maintaining the metal concentration in the plating bath. Although effective at replacing plated metal ions, using consumable anodes requires a relatively complex and costly design to allow the consumable anodes to be replaced. Even more complexity is added when consumable anodes are combined with a membrane to avoid degrading the electrolyte, or oxidizing the consumable anodes during idle state operation.

Thus, there is a need for improved systems and methods that can be used to produce high quality devices and structures while protecting both the substrate and the plating baths. These and other needs are addressed by the present technology.

SUMMARY

Electroplating systems may include an electroplating chamber. The systems may also include a replenish assembly fluidly coupled with the electroplating chamber. The replenish assembly may include a first compartment housing anode material. The first compartment may include a first compartment section in which the anode material is housed and a second compartment section separated from the first compartment section by a divider. The replenish assembly may include a second compartment fluidly coupled with the electroplating chamber and electrically coupled with the first compartment. The replenish assembly may also include a third compartment electrically coupled with the second compartment, and the third compartment may include an inert cathode.

In some embodiments, the system may include a voltage source coupling the anode material with the inert cathode. The first compartment may include an anolyte, the second compartment may include a catholyte, and the third compartment may include a thiefolyte. The third compartment may be fluidly coupled with the electroplating chamber to deliver thiefolyte between the third compartment and the electroplating chamber. The second compartment may be fluidly coupled with the electroplating chamber. The systems may include a first ionic membrane positioned between the second compartment section of the first compartment and the second compartment. The systems may include a second ionic membrane positioned between the second compartment and the third compartment. The second ionic membrane may be a monovalent membrane. The systems may include a pump fluidly coupled between the first compartment section of the first compartment and the second compartment section of the first compartment. The pump may be operable in a first setting to flow anolyte from the first compartment section of the first compartment to the second compartment section of the first compartment. A fluid path may be defined about the divider so that anolyte flows from the second compartment section of the first compartment to the first compartment section of the first compartment when the pump is operating in the first setting. The pump may be operable in a second setting to fully drain the anolyte from the second compartment section of the first compartment. The systems may include an insert seated in the second compartment. The insert may define at least one fluid channel along the insert. The systems may include a compartment disposed within the first compartment section of the first compartment. The compartment may house the anode material. The divider may be an ionic membrane fluidly isolating a flow path between the first compartment section of the first compartment to the second compartment section of the first compartment.

Some embodiments of the present technology may encompass methods of operating an electroplating system. The methods may include driving a voltage through a replenish assembly. The replenish assembly may include a first compartment housing anode material. The first compartment may have a first compartment section in which the anode material is housed and a second compartment section separated from the first compartment section by a divider. The replenish assembly may include a second compartment fluidly coupled with an electroplating chamber and electrically coupled with the first compartment. The replenish assembly may include a third compartment electrically coupled with the second compartment. The third compartment may include an inert cathode. The voltage may be driven from the anode material to the inert cathode through the first compartment section of the first compartment, the second compartment section of the first compartment, the second compartment, and the third compartment. The methods may include providing ions of the anode material to a catholyte flowing through the second compartment.

In some embodiments, the methods may include reversing the voltage between the anode material and the inert cathode. The methods may include removing plated anode material from the inert cathode. The methods may include pumping an anolyte from the second compartment section of the first compartment to the first compartment section of the first compartment to drain the second compartment section of the first compartment. The replenish assembly may include a first ionic membrane positioned between the second compartment section of the first compartment and the second compartment. The replenish assembly may include a second ionic membrane positioned between the second compartment and the third compartment. The pumping may maintain the first ionic membrane in fluid contact only with the catholyte.

Some embodiments of the present technology may encompass electroplating systems. The systems may include an electroplating chamber. The systems may include a replenish assembly fluidly coupled with the electroplating chamber. The replenish assembly may include a first compartment housing anode material and an anolyte. The first compartment may have a first compartment section in which the anode material is housed and a second compartment section separated from the first compartment section by a divider. A fluid circuit may be defined between the first compartment section and the second compartment section. The replenish assembly may include a second compartment fluidly coupled with the electroplating chamber and electrically coupled with the first compartment. The second compartment may contain catholyte. The replenish assembly may include a first ionic membrane positioned between the second compartment section of the first compartment and the second compartment. The replenish assembly may include a third compartment electrically coupled with the second compartment. The third compartment may include an inert cathode. The third compartment may include an acid thiefolyte. The replenish system may include a second ionic membrane positioned between the second compartment and the third compartment. In some embodiments, the divider may be a third ionic membrane.

Such technology may provide numerous benefits over conventional technology. For example, the present technology may limit additive losses during a system idle state. Additionally, the systems may also limit plating defects due to air entrainment in the catholyte. These and other embodiments, along with many of their advantages and features, are described in more detail in conjunction with the below description and attached figures.

BRIEF DESCRIPTION OF THE DRAWINGS

A further understanding of the nature and advantages of the disclosed embodiments may be realized by reference to the remaining portions of the specification and the drawings.

Figure 1:
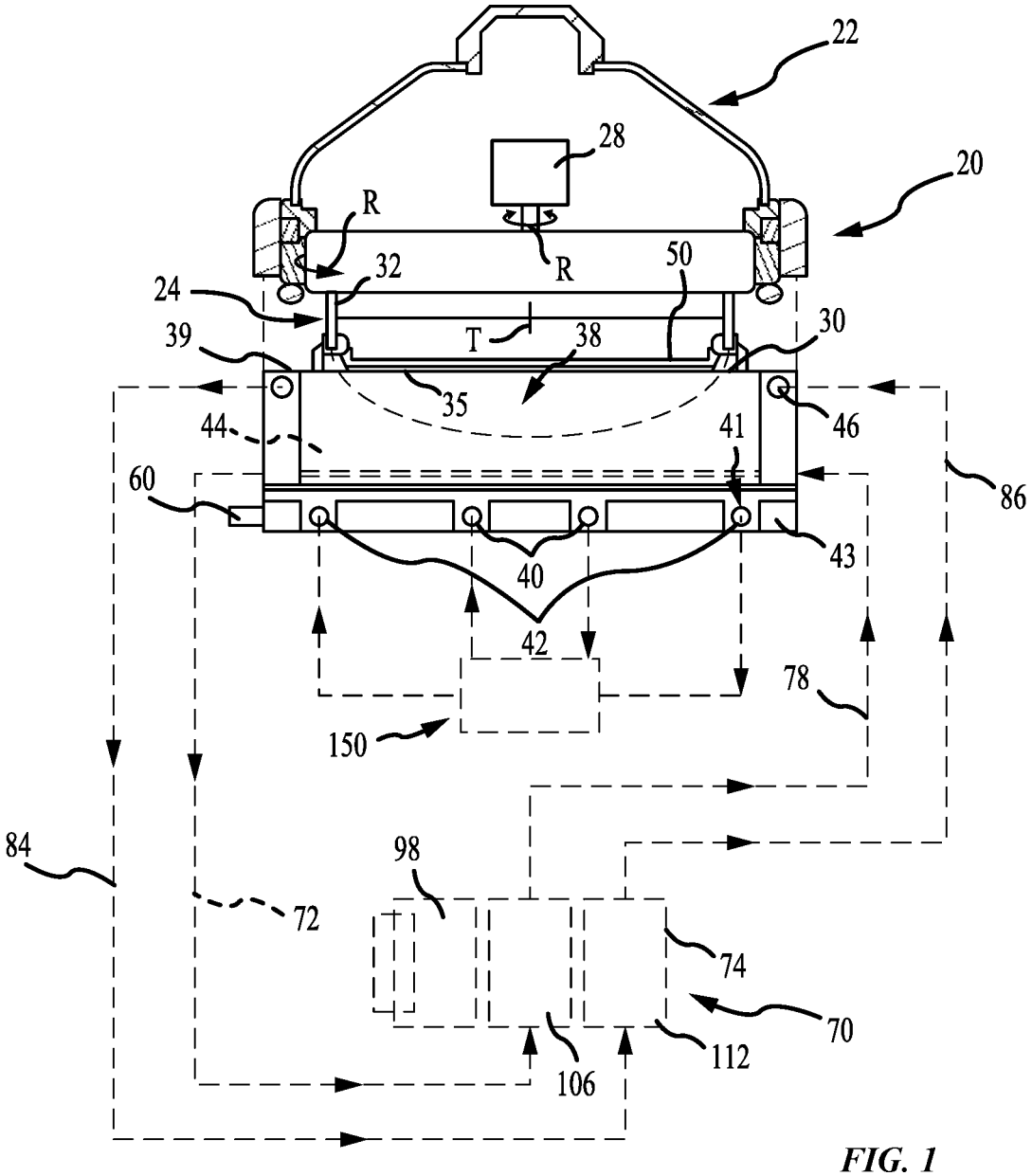
FIG. 1 shows a schematic view of an electroplating processing system according to some embodiments of the present technology.

Several of the figures are included as schematics. It is to be understood that the figures are for illustrative purposes, and are not to be considered of scale unless specifically stated to be of scale. Additionally, as schematics, the figures are provided to aid comprehension and may not include all aspects or information compared to realistic representations, and may include exaggerated material for illustrative purposes.

In the figures, similar components and/or features may have the same numerical reference label. Further, various components of the same type may be distinguished by following the reference label by a letter that distinguishes among the similar components and/or features. If only the first numerical reference label is used in the specification, the description is applicable to any one of the similar components and/or features having the same first numerical reference label irrespective of the letter suffix.

DETAILED DESCRIPTION

Various operations in semiconductor manufacturing and processing are performed to produce vast arrays of features across a substrate. As layers of semiconductors are formed, vias, trenches, and other pathways are produced within the structure. These features may then be filled with a conductive or metal material that allows electricity to conduct through the device from layer to layer.

Electroplating operations may be performed to provide conductive material into vias and other features on a substrate. Electroplating utilizes an electrolyte bath containing ions of the conductive material to electrochemically deposit the conductive material onto the substrate and into the features defined on the substrate. The substrate on which metal is being plated operates as the cathode. An electrical contact, such as a ring or pins, may allow the current to flow through the system. During electroplating, a substrate may be clamped to a head and submerged in the electroplating bath to form the metallization. Metal ions may be deposited on the substrate from the bath.

In plating systems utilizing an inert anode, an additional source of metal ions may be used to replenish a catholyte solution. The present technology utilizes a separate replenish assembly that may utilize an anode material to replace plated metal ions into a catholyte solution. This assembly may be fluidly coupled with multiple plating chambers, which may help limit downtime to otherwise replenish materials. However, when the system is not being operated, new challenges may occur.

The replenish module may have anolyte, catholyte, and thiefolyte included in separate compartments of the replenish assembly separated by two membranes between the compartments. During idle states, although ion transmission may be limited, additives may be lost. Plating baths may include organic compounds and other additives that facilitate plating operations. For example, accelerators, levelers, and suppressors for certain ions may be included in the catholyte solution. These additives may deposit out on membranes or may otherwise be transmitted from the catholyte, which may detrimentally affect subsequent plating if not replaced. This loss may be reduced by draining the fluid compartments during idle states, but this may cause additional challenges. Draining the anolyte compartment may expose the anode material to air, which may cause oxidation to occur and limit functionality. Draining the catholyte compartment and then refilling on startup may introduce air bubbles into the catholyte fluid loop, which may affect deposition by creating voids at the wafer.

Replenish assemblies according to the present technology may overcome these issues by including a divider in the anolyte compartment of a three-compartment module. By allowing a portion of the anolyte compartment to be drained into the main portion of the anolyte compartment, the anode material may be maintained submerged in anolyte, while an airspace may be formed adjacent the catholyte compartment. Advantageously, this may also maintain all fluid membranes in contact with fluid on a single side during a system idle state. This may limit drying of the membranes, which can otherwise shrink and break when dried. Although draining and refilling the anolyte compartment may entrain an amount of air in that circuit, this may not be detrimental to processing, as the anolyte may not come into contact with the workpiece. On the other hand, draining and filling the catholyte compartment may entrain air that contact a substrate being processed, and which may cause plating defects on the substrate where plating may not occur. After describing an exemplary system in which embodiments of the present technology may be incorporated, the remaining disclosure will discuss aspects of the systems and processes of the present technology.

FIG. 1 shows a schematic view of an electroplating processing system according to some embodiments of the present technology. In FIG. 1, an electroplating chamber 20 may include a rotor 24 in a head 22 for holding a wafer 50. The rotor 24 may include a contact ring 30 which may move vertically to engage contact fingers 35 on the contact ring 30 onto the down facing surface of a wafer 50. The contact fingers 35 may be connected to a negative voltage source during electroplating. A bellows 32 may be used to seal internal components of the head 22. A motor 28 in the head may rotate the wafer 50 held in the contact ring 30 during electroplating. The chamber 20 may alternatively have various other types of head 22. For example, the head 22 may operate with a wafer 50 held in a chuck rather than handling the wafer 50 directly, or the rotor and motor may be omitted with the wafer held stationery during electroplating. A seal on the contact ring may seal against the wafer to seal the contact fingers 35 away from the catholyte during processing. The head 22 may be positioned over an electroplating vessel 38 of the electroplating chamber 20. One or more inert anodes may be provided in the vessel 38. In the example shown, the electroplating chamber 20 may include an inner anode 40 and an outer anode 42. Multiple electroplating chambers 20 may be provided in columns within an electroplating system, with one or more robots moving wafers in the system.

Figure 2:
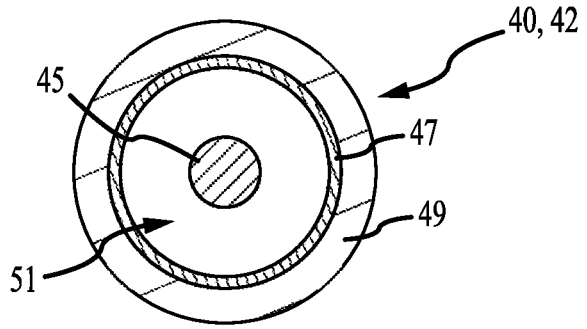
FIG. 2 shows a cross-sectional view of an inert anode according to some embodiments of the present technology.

FIG. 2 shows a cross-sectional view of an inert anode according to some embodiments of the present technology. In FIG. 2 the anodes 40 and 42 may include a wire 45 within a membrane tube 47. The membrane tube 47 may have an outer protective sleeve or covering 49. The membrane tube 47, including the electrode wire, may be circular, or optionally formed into a spiral, or linear arrays, or take another form appropriate to create the electric field adapted for the workpiece being processed. In some embodiments, the wire 45 may be up to a 2 mm diameter platinum wire within a 2-3 mm inside diameter membrane tube 47. The wire 45 may also be a platinum clad wire with an interior core of another metal such as niobium, nickel, or copper. A resistive diffuser may be provided in the vessel above the inert anodes. A flow space 51 may be provided around the wire 45 within the membrane tube 47. Although the wire 45 may be nominally centered within the membrane tube 47, in practice the position of the wire within the membrane tube can vary, to the extent that the wire may be touching the inside wall of the membrane tube, at some locations. Spacers may be used to maintain the wire within the tube, although no spacers or other techniques to center the wire within the membrane tube may be needed.

Additionally illustrated in FIG. 1 is a three-compartment replenish assembly 70, which will be described in further detail below. During electroplating, process anolyte may be pumped through a process anolyte loop that includes the anode membrane tubes 47 and a process anolyte chamber 150 which is a process anolyte source to the anodes 40 and 42. The membrane tubes forming the anodes 40 and 42 may be formed into a ring or circle, contained within a circular slot 41 in an anode plate 43 of the vessel 38, as shown with the membrane tubes resting on the floor of the vessel 38. The replenishing system 70 may be external to the chamber 20 in that it is a separate unit which may be located remote from the processor, within a processing system. This may allow a replenish assembly to be fluidly coupled with multiple electroplating chambers, where the replenish assembly by replenish catholyte used by any number of chambers.

The wire 45 of each anode 40, 42 may be electrically connected to a positive voltage source relative to the voltage applied to the wafer to create an electric field within the vessel. Each of the inert anodes may be connected to one electrical power supply channel, or they may be connected to separate electrical power supply channels, via an electrical connector 60 on the vessel 38. One to four inert anodes may typically be used. The anolyte flow through the membrane tubes may carry the gas out of the vessel. In use, the voltage source may induce an electric current flow causing conversion of water at the inert anode into oxygen gas and hydrogen ions and the deposition of copper ions from the catholyte onto the wafer.

The wire 45 in the anodes 40 and 42 may be inert and may not react chemically with the anolyte. The wafer 50, or a conductive seed layer on the wafer 50, may be connected to a negative voltage source. During electroplating, the electric field within the vessel 38 may cause metal ions in the catholyte to deposit onto the wafer 50, creating a metal layer on the wafer 50.

The metal layer plated onto the wafer 50 may be formed from metal ions in the chamber catholyte which move to the wafer surface due to chamber catholyte flow and ion diffusion in the vessel 38. A catholyte replenishing system 70 may be fluidly coupled with the electroplating chamber to supply metal ions back into the system catholyte. The replenishing system 70 may include a chamber catholyte return line, which may be or include a tube or pipe, and a chamber catholyte supply line 78 connecting a replenish assembly 74 in a catholyte circulation loop. In some embodiments, an additional catholyte tank may be included in the catholyte circulation loop, with the chamber catholyte tank supplying catholyte to multiple electroplating chambers 20 within a processing system. The catholyte circulation loop may include at least one pump, and may also include other components such as heaters, filters, valves, and any other fluid loop or circulation components. The replenish assembly 74 may be in line with the catholyte return, or it may alternatively be connected in a separate flow loop out of and back to the catholyte tank.

Figure 3:
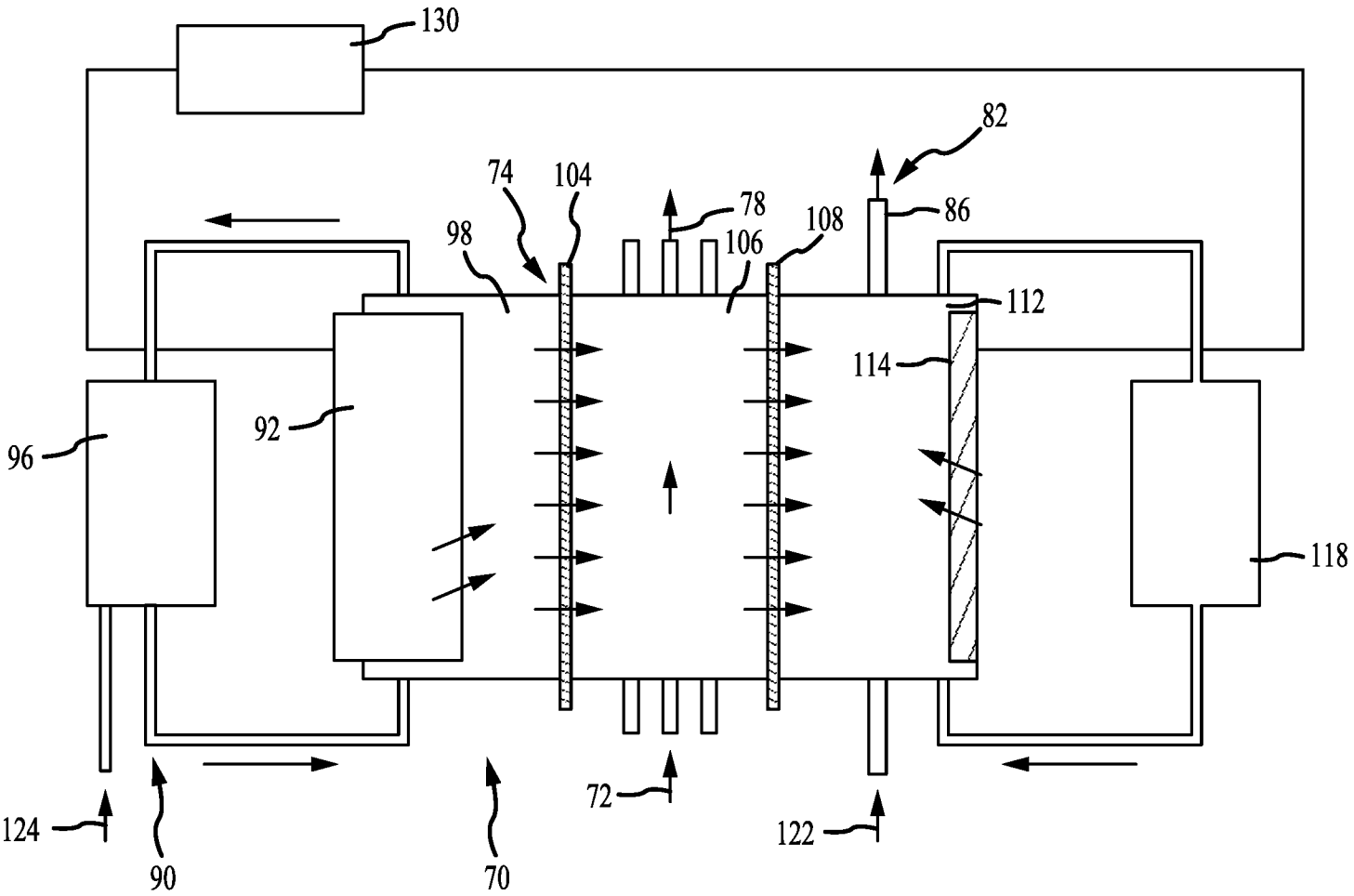
FIG. 3 shows a schematic view of a replenish assembly according to some embodiments of the present technology.

FIG. 3 shows a schematic view of a replenish assembly according to some embodiments of the present technology, and may provide details of replenish assemblies described further below. The figure shows an enlarged schematic view of the replenish assembly 74 as operational components that may be applicable to any number of specific replenish assembly configurations, including those described further below. A replenish assembly anolyte may circulate within the replenish assembly 74 through a replenish assembly anolyte loop 90 including a replenish assembly anolyte compartment 98, which may be a first compartment of the replenish assembly, and optionally a replenish assembly anolyte tank 96. In some embodiments, such as for copper plating, the replenish assembly anolyte may be a copper sulfate electrolyte with no acid, although it is to be understood that the system may be used for any number of electroplating operations utilizing chemistries and materials suitable for those operations. The anolyte replenish assembly within the replenish assembly 74 may not require a recirculation loop and may include just an anolyte compartment 98. A gas sparger, for example a nitrogen gas sparger, can provide agitation for the replenish assembly without the complication of a recirculation loop requiring plumbing and a pump. Again referring to a copper plating system, as a non-limiting example, if a low acid electrolyte or anolyte is used, when current is passed across the replenish assembly, Cu' ions may transport or move across the membrane into the catholyte, rather than protons. Gas sparging may also reduce oxidation of bulk copper material.

A de-ionized water supply line 124 may supply make-up de-ionized water into the replenish assembly anolyte tank 96 or the compartment 98. Bulk plating material 92, such as copper pellets for example, may be provided in the replenish assembly anolyte compartment 98 and provide the material which may be plated onto the wafer 50. A pump may circulate replenish assembly anolyte through the replenish assembly anolyte compartment 98. The replenish assembly anolyte may be entirely separate from the anolyte provided to the anodes 40 and/or 42. Additionally, in some embodiments, an anolyte compartment 98 may be used without any replenish assembly anolyte loop 90. A gas sparger, for example, or some other pumping system can provide agitation for the anolyte compartment 98 without using a replenish assembly anolyte loop. For example, some embodiments of anolyte compartments, or first compartments, may include an anolyte replenish tank, or may simply circulate anolyte within the compartment, or within two sections of the compartment as will be described further below.

Within the replenish assembly 74, a first cation membrane 104 may be positioned between the replenish assembly anolyte in the replenish assembly anolyte compartment 98 and catholyte in a catholyte compartment 106, to separate the replenish assembly anolyte from the catholyte. The catholyte return line 72 may be connected to one side of the catholyte compartment 106 and the catholyte supply line 78 may be connected to the other side of the catholyte compartment 106, which may allow circulation of catholyte from the vessel 38 through the catholyte chamber. Alternately, the catholyte flow loop through the replenish assembly 74 may be a separate flow circuit with the catholyte tank. The first cation membrane 104 may allow metal ions and water to pass through the replenish assembly anolyte compartment 98 into the catholyte in the catholyte chamber, while otherwise providing a barrier between the replenish assembly anolyte and the catholyte. Deionized water may added to the catholyte to replenish water lost to evaporation, but more commonly water evaporation can be enhanced to evaporate the water entering into the catholyte through electro-osmosis from the anolyte replenish assembly. An evaporator may also be included to facilitate removal of excess water.

The flow of metal ions into the catholyte may replenish the concentration of metal ions in the catholyte. As metal ions in the catholyte are deposited onto the wafer 50 to form the metal layer on the wafer 50, they may be replaced with metal ions originating from the bulk plating material 92 moving through the replenish assembly anolyte and the first membrane 104 into the catholyte flowing through the catholyte compartment 106 of the replenish assembly 74.

An inert cathode 114 may be located in the thiefolyte compartment 112 opposite from the second cation membrane 108. The negative or cathode of a power supply 130, such as a DC power supply, may be electrically connected to the inert cathode 114. The positive or anode of the power supply 130 may be electrically connected to the bulk plating material 92 or metal in the replenish assembly anolyte compartment 98 applying or creating a voltage differential across the replenish assembly 74. Replenish assembly electrolyte in the thiefolyte compartment 112 may optionally circulate through a replenish assembly tank 118, with deionized water and sulfuric acid added to the replenish assembly electrolyte via an inlet 122. The thiefolyte compartment 112 electrolyte may include, for example, deionized water with 1-10% sulfuric acid. The inert cathode 114 may be a platinum or platinum-clad wire or plate. The second ionic membrane 108 may help to retain copper ions in the second compartment. Additionally, the second ionic membrane 108 may be configured to particularly maintain Cu' within the catholyte. For example, in some embodiments, the second ionic membrane may be a monovalent membrane, which may further limit passage of copper through the membrane.

Referring back to FIGS. 1 and 2, the chamber 20 may optionally include an electric current thief electrode 46 in the vessel 38, although in some embodiments no electric current thief may be included. In some embodiments, the electric current thief electrode 46 may also have an electric current thief wire within an electric current thief membrane tube, similar to the anode 40 or 42 described above. If a thief electrode is used, reconditioning electrolyte may be pumped through the electric current thief membrane tube. The electric current thief wire may be generally connected to a negative voltage source which is controlled independently of the negative voltage source connected to the wafer 50 via the contact ring 30. The electric current thief membrane tube may be connected to a thiefolyte compartment 112 in the replenish assembly 74 via a replenish assembly circulation loop, generally indicated at 82, via a replenish assembly electrolyte return line 84 and a replenish assembly electrolyte supply line 86. If used, the high acid catholyte bath in catholyte compartment 106 may ensure that a high portion of the current crossing membrane 108 may be protons rather than metal ions. In this way, the current within the replenish assembly 74 may replenish the copper within the catholyte while preventing it from being lost through the membrane.

A second cation membrane 108 may be positioned between the catholyte in the catholyte compartment 106 and the replenish assembly electrolyte in the thiefolyte compartment 112. The second cation membrane 108 may allow protons to pass through from the catholyte in the catholyte compartment 106 into the replenish assembly electrolyte in the thiefolyte compartment 112, while limiting the amount of metal ions that pass through the membrane, which may then plate out on the inert cathode. The primary function of thiefolyte compartment 112 is to complete the electrical circuit for the replenish assembly chamber in a way that does not plate metal out onto the inert cathode 114. The thiefolyte compartment 112 may be used with or without an extra tank or circulation loop. The high acid electrolyte or catholyte bath in catholyte compartment 106 may ensure that a high portion of the current crossing membrane 108 is protons rather than metal ions, so that the cathode reaction on the inert cathode 114 is mostly hydrogen evolution. In this way, the current within the replenish assembly 74 replenishes the copper within the catholyte while preventing it from being lost through membrane 108.

During idle state operation, when the replenish assembly is not in use, the replenishing system 70 stops the flow of catholyte over the bulk plating material 92 which forms the consumable anode. In some embodiments, the thiefolyte may be drained from the thiefolyte compartment during idle state to limit additional loss of copper, additives, or other bath constituents from the catholyte due to diffusion, or other transport mechanisms, of Cu' across membrane 108. However, as explained above, challenges may exist both by leaving catholyte and anolyte within the respective compartments, as well as draining the two materials. Draining the catholyte may facilitate air entrainment on startup, which may detrimentally impact plating. Draining the anolyte may expose the anode material leading to oxidation. However, leaving the two electrolytes within the respective chambers may allow a gradient occurring between the materials across the membrane to cause additives to be lost from the catholyte. Accordingly, some embodiments of the present technology may incorporate an additional divider that may be utilized to separate the anolyte and catholyte within their respective compartments during idle state operation.

Figure 4:
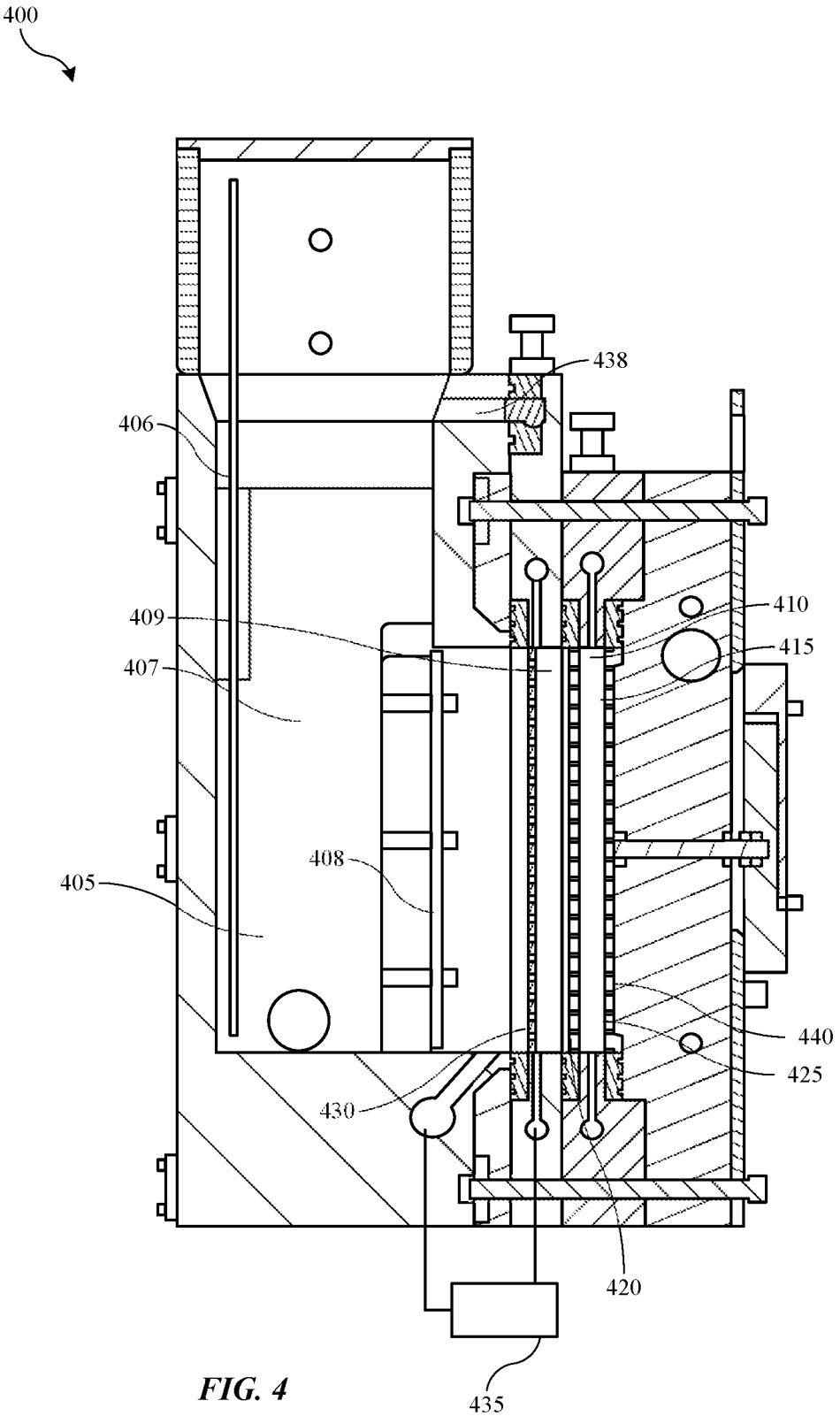
FIG. 4 shows a schematic cross-sectional view of a replenish assembly according to some embodiments of the present technology.

Turning to FIG. 4 is shown a schematic cross-sectional view of a replenish assembly 400 according to some embodiments of the present technology. Replenish assembly 400 may include any of the features, components or characteristics of replenish assembly 74, and may be incorporated in replenishing system 70 described above. Replenish system 400 may illustrate additional features of replenish assembly 74 according to some embodiments of the present technology.

Replenish assembly 400 may include a three-compartment cell including an anolyte compartment 405, or a first compartment, a catholyte compartment 410, or a second compartment, and a thiefolyte compartment 415, or a third compartment. The assembly may also include a first ionic membrane 420 between the anolyte compartment and the catholyte compartment, and may include a second ionic membrane 425 between the catholyte compartment and the thiefolyte compartment. Additionally, to overcome issues during idle state as previously described, an additional divider 430 may be included within the anolyte compartment 405, which may provide a fluid separation between a first compartment section 407 and a second compartment section 409 within the anolyte compartment. Each compartment section of the anolyte compartment may only be accessed by anolyte in a continuous loop within the anolyte compartment 405, although the additional divider 430 may facilitate operations as will be described further below.

Anolyte compartment 405 may include an electrode 406, which may be coupled with a power supply as previously described. Anode material, such as copper pellets or other metal materials used in plating, may be deposited in the cell in contact with the electrode 406. For example a retainer 408 or screen may be included to maintain anode material against the electrode and away from contacting the ionic membranes. As will be described below, a removable container may also be used to ensure the anode material is housed within the anolyte compartment and in contact with an electrode.

Divider 430 may also be an ionic membrane, which may ensure that when anolyte is flowed in each section of the anolyte compartment, the first compartment section may be electrically coupled with the second compartment section, while allowing fluid separation that may be used to fluidly isolate the compartments allowing a drain operation to occur during idle state. In some embodiments, a pump 435 or pumping system may be connected to each of the first compartment section and the second compartment sections of the anolyte compartment 405, and may be operable to pump fluid into and/or out of the second compartment section of the anolyte compartment. Anolyte may be pumped into the second compartment section 409 from the first compartment section 407, which may rise within the second compartment section and fill the second compartment section, which may be between divider 430 and first ionic membrane 420. The fluid may be pumped continuously to ensure consistency of the anolyte within the compartment sections. As fluid fills the second compartment section of anolyte compartment 405, the fluid may enter a spillway 438, which may allow the anolyte to pour back into the first compartment section 407 forming a continuous fluid loop within the anolyte compartment 405 between the two sections as will be explained further below.

Catholyte compartment 410 may be fluidly coupled with the electroplating chamber as previously described and may be filled with catholyte that may be maintained within the catholyte compartment 410 during idle states as will be described further below. The catholyte compartment 410 may be separated from the thiefolyte compartment 415 by the second ionic membrane 425, which may be a monovalent membrane in some embodiments. The thiefolyte compartment may have thiefolyte flowed within the space that may also include an inert cathode 440 electrically coupled with the power supply as previously described. Accordingly, the power supply may operate as a voltage source coupling the anode material with the inert cathode 440 through the three compartments of the chamber, which may each be electrically coupled together through the individual electrolytes and the ionic membranes.

Figure 5:
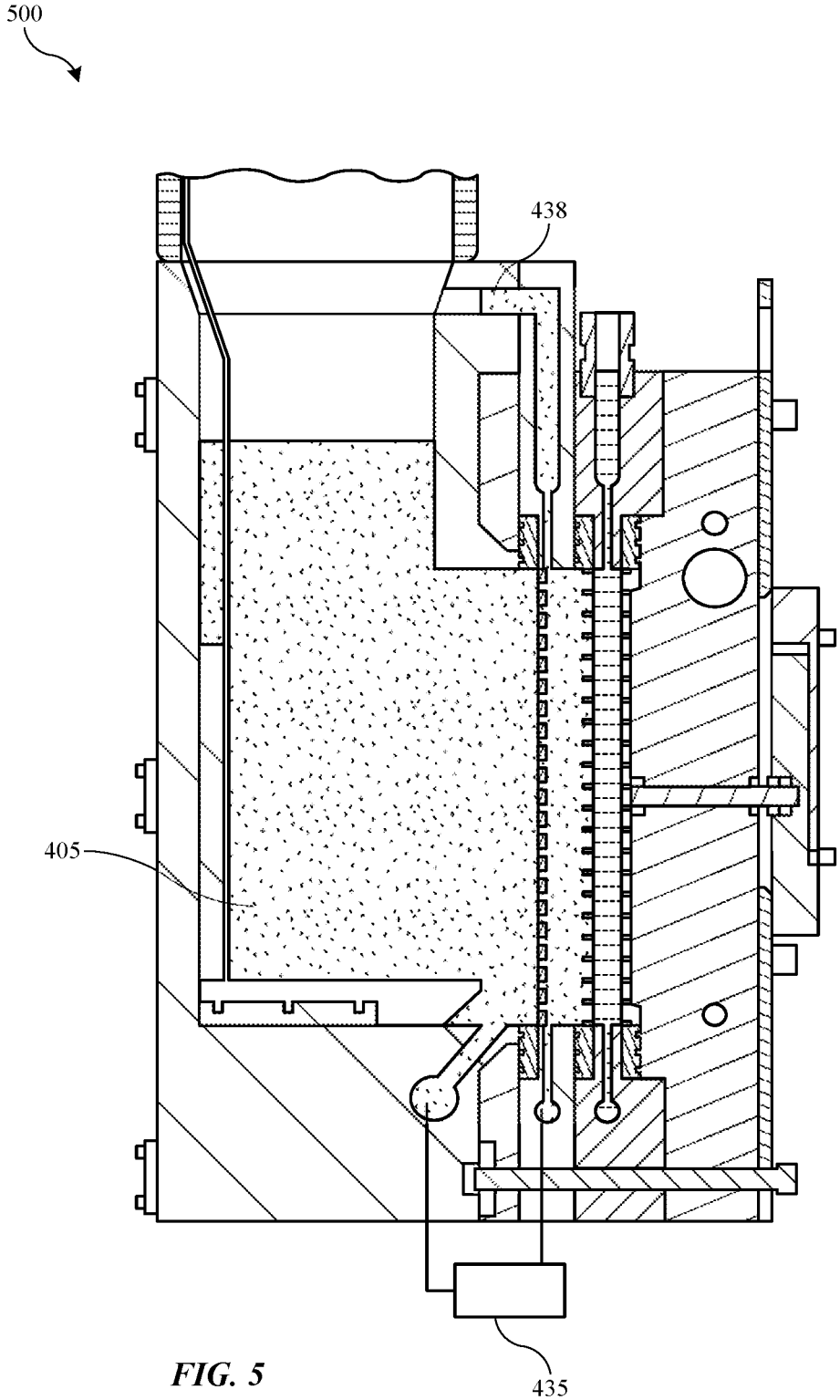
FIG. 5 shows a schematic cross-sectional view of a replenish assembly to some embodiments of the present technology.

FIG. 5 shows a schematic cross-sectional view of a replenish assembly 500 according to some embodiments of the present technology, and may illustrate replenish assembly 400 during operation. Replenish assembly 500 may include any of the components or features of systems or assemblies previously described, and may be incorporated within an electroplating system as discussed above.

As illustrated, replenish assembly 500 may include an anolyte in anolyte compartment 405, which during a first operation to replenish ions into a catholyte may be flowed through each of the first compartment section and the second compartment section of the anolyte compartment. Put another way, during a first operation for replenishing, pump 435 may be operable in a first setting to flow anolyte from the first compartment section to the second compartment section of the anolyte compartment 405. As illustrated, the anolyte may then contact the first ionic membrane adjacent the catholyte compartment, which may flow catholyte against the opposite side of the membrane. The anolyte may continue to flow up through the second compartment section of the anolyte compartment and may flow over the spillway 438 back into the first compartment section of the anolyte compartment 405. The spillway 438 may operate as a fluid path extending over the divider to produce a fluid loop that may flow continuously during operation.

Figure 6:
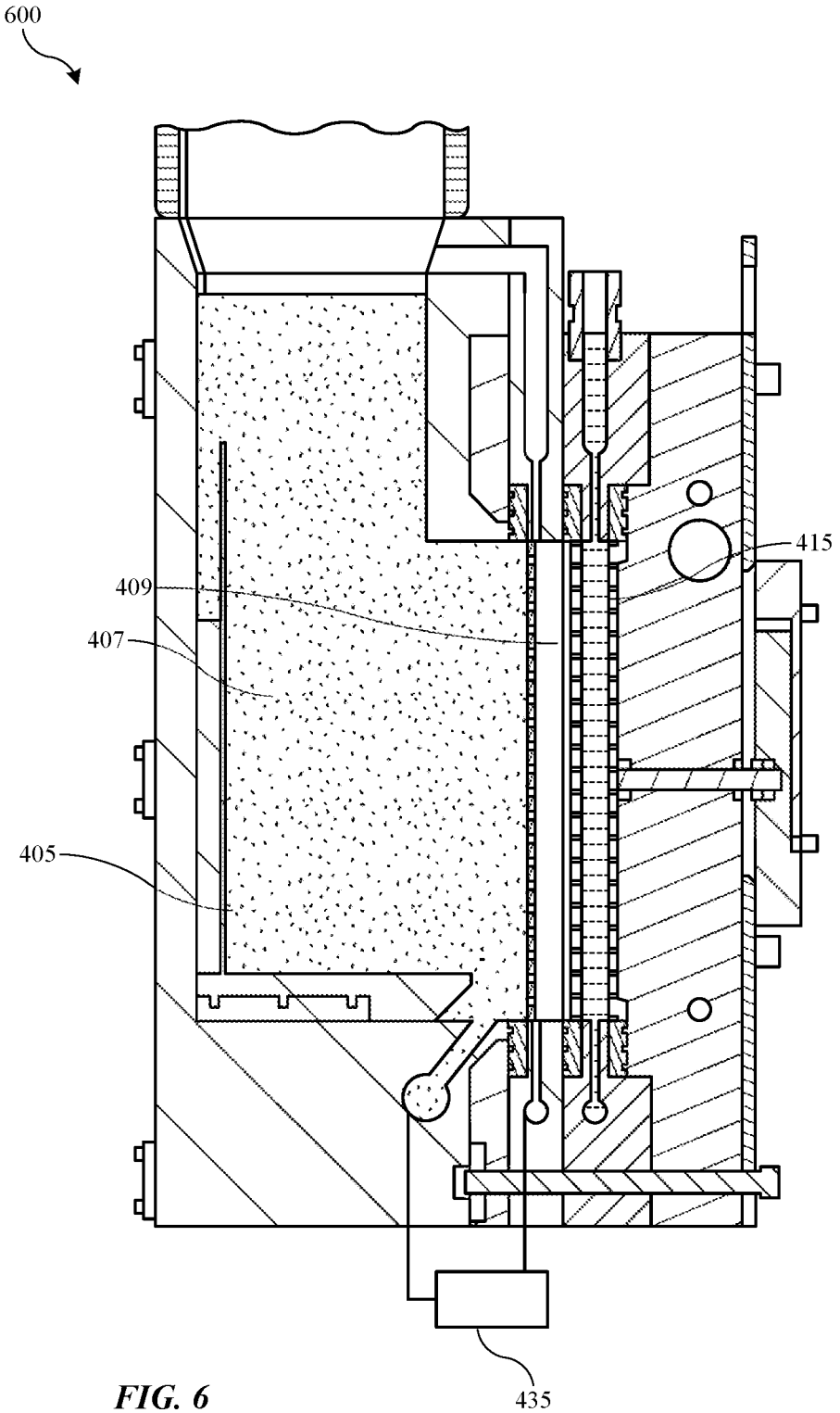
FIG. 6 shows a schematic cross-sectional view of a replenish assembly according to some embodiments of the present technology.

FIG. 6 shows a schematic cross-sectional view of a replenish assembly 600 according to some embodiments of the present technology, and may illustrate replenish assembly 400 during operation. Replenish assembly 600 may include any of the components or features of systems or assemblies previously described, and may be incorporated within an electroplating system as discussed above.

As illustrated, replenish assembly 600 may include an anolyte in anolyte compartment 405, which during a second operation of the system in ide state may be maintained within the first compartment section 407, while being drained from the second compartment section 409 of the anolyte compartment 405. Put another way, during a second operation of the system in an idle or standby state, pump 435 may be operable in a second setting, which may be a reverse from the first setting, to drain anolyte from the second compartment section 409 and pump it back to the first compartment section 407 of the anolyte compartment 405. As illustrated, first compartment section 407 may include additional headspace volume within the compartment section, which may allow the entire volume of the second compartment section 409 to be pumped back into the first compartment section 407 of the anolyte compartment.

Thiefolyte compartment 415 may similarly be drained of thiefolyte during idle state, which may prevent additional copper migration through the second ionic membrane and plating on the inert cathode. Catholyte may be retained within the catholyte compartment, which may allow the entire catholyte fluid circuit to the electroplating chamber to remain full, which may prevent air entrainment within the loop. This configuration may provide multiple benefits including maintaining all fluid separated within the replenish assembly during idle state. Additionally, each ionic membrane, which may include divider 430 as a third ionic membrane, may be maintained in contact with an electrolyte along a surface of the membrane. For example, as illustrated, the first ionic membrane may be maintained in contact with only the catholyte during idle states, and may be maintained substantially free or essentially free of anolyte, less an amount of residual anolyte that may be retained on the membrane. This may ensure the membranes do not dry out during idle time periods, which may prevent cracking and failure of the membranes. Additionally, anode materials retained in first compartment section 407 may remain fully submerged in anolyte, which may prevent oxidation. Thus, by incorporating the second compartment section of the anolyte compartment by including the additional divider within the anolyte compartment, an idle state configuration may be produced that limits or prevents migration across membranes between stagnant fluids.

Figure 7:
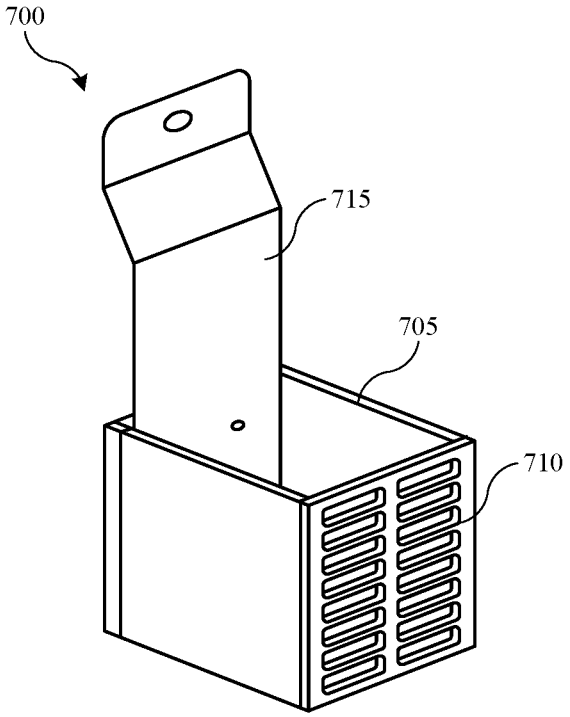
FIG. 7 shows a schematic perspective view of an anode material container according to some embodiments of the present technology.

Turning to FIG. 7 is shown a schematic perspective view of an anode material container 700 according to some embodiments of the present technology. As discussed previously, an anode material, such as copper pellets or material to replenish metal ions, may be included within the anolyte compartment, such as within the first compartment section of the anolyte compartment where anolyte may be maintained during operation and idle state. In some embodiments, a container 700 may be included that include a compartment 705 that can retain the anode materials to prevent contact with the ionic membranes, which may cause tearing or other punctures through the membrane. Compartment 705 may include a front screen 710, which may allow anolyte to flow through the compartment during operation. Additionally, electrode 715 may extend into the compartment as illustrated, which may further ensure electrical communication with the anode material. For example, the compartment 705 may be electrically conductive, which may ensure that the anode material is in electrical contact with the power supply. It is to be understood that a container 700 may be incorporated in any of the assemblies or configurations previously described.

Figure 8:
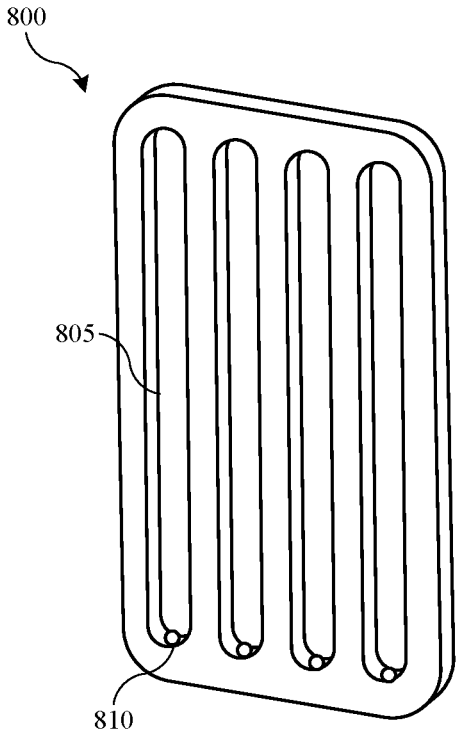
FIG. 8 shows a schematic perspective view of a cell insert according to some embodiments of the present technology.

FIG. 8 shows a schematic perspective view of a cell insert 800 according to some embodiments of the present technology. Cell insert 800 may be included within the catholyte compartment in some embodiments to restrict the amount of fluid flowed through the compartment at any time. During idle states, a volume of catholyte may be retained within the catholyte compartment, and which may be in contact with the first ionic membrane and the second ionic membrane. Additives may still be expressed from the catholyte onto the membranes, and which may not all reabsorb into the catholyte on restart. Accordingly, by reducing the volume of catholyte in the catholyte compartment in some embodiments, additional loss of additives may be limited or prevented.

Figure 9:
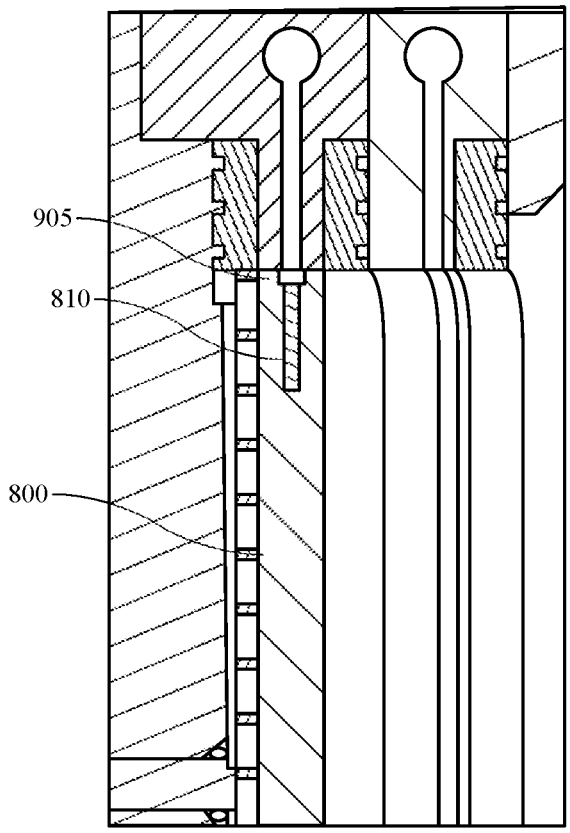
FIG. 9 shows a schematic cross-sectional partial view of a cell insert in a replenish assembly according to some embodiments of the present technology.

Cell insert 800 may define one or more, including a plurality of fluid channels 805 through the insert. Apertures 810 may be formed through the two ends of the cell insert in the direction of the channels 805 formed. FIG. 9 shows a schematic cross-sectional partial view of the cell insert 800 in a replenish assembly according to some embodiments of the present technology, such as within a catholyte compartment as previously described. It is to be understood that cell insert 800 may be included in any of the assemblies or configurations previously described. As illustrated, cell insert 800 may extend laterally within the catholyte compartment to restrict the available volume for catholyte flow. In some embodiments the cell insert 800 may contact one or both of the first ionic membrane or the second ionic membrane, although a small amount of fluid space may be maintained between the components to ensure adequate wetting of the membrane. A recessed channel 905 may be formed within the top and bottom of the cell insert that may provide fluid access to the apertures 810. Apertures 810 may provide fluid from the recessed channels to the fluid channels defined vertically through the cell insert. Cell inserts according to the present technology may restrict the volume within the catholyte compartment or any other compartment by greater than or about 10%, and may restrict the volume within the compartment by greater than or about 20%, greater than or about 30%, greater than or about 40%, greater than or about 50%, greater than or about 60%, greater than or about 70%, greater than or about 80%, greater than or about 90%, or more.

Figure 10:
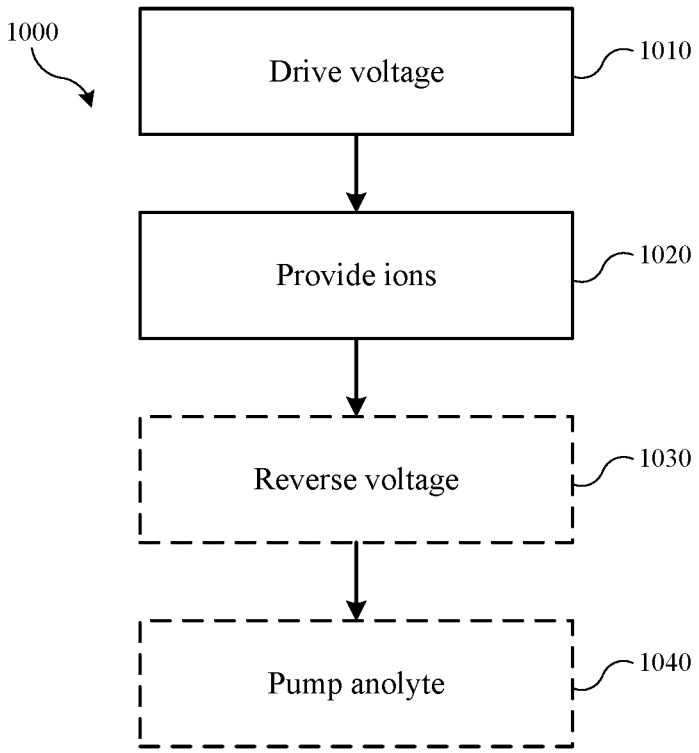
FIG. 10 shows exemplary operations in a method of operating an electroplating system according to some embodiments of the present technology.

FIG. 10 shows exemplary operations in a method 1000 of operating an electroplating system according to some embodiments of the present technology. The method may be performed in a variety of processing systems, including electroplating systems described above, which may include replenish assemblies according to embodiments of the present technology, such as replenish assembly 400, which may include any of the additional components or features discussed throughout the present disclosure. Method 1000 may include a number of optional operations, which may or may not be specifically associated with some embodiments of methods according to the present technology.

Method 1000 may include a processing method that may include operations for operating an electroplating system, which may include a replenish assembly as previously described. The method may include optional operations prior to initiation of method 1000, or the method may include additional operations. For example, method 1000 may include operations performed in different orders than illustrated. In some embodiments, method 1000 may include driving a voltage through a replenish assembly at operation

1010, which may include a three-compartment assembly including any of the components, features, or characteristics of assemblies or devices previously described. The assembly may include a divider within the anolyte compartment, which may be used to facilitate idle operations as previously described. The method may include providing ions of an anode material at operation 1020. The ions may be metal ions provided to or replenishing a catholyte flowing through a catholyte compartment of the assembly.

In some embodiments, subsequent a plating operation, the voltage may be reversed between the anode material and the cathode, which may be an inert cathode, at optional operation 1030. This may allow any material that may have passed through the catholyte into a thiefolyte and plated on the inert cathode to be provided back into the plating solution and removed from the inert cathode. In some embodiments the voltage reversal operations may be performed at regular intervals. While a system may be run for an extended period of time followed by an extended voltage reversal, in some embodiments the reversal may be performed at more regular intervals for shorter periods of time. This may facilitate maintaining metal within the catholyte and may limit formation of dendrites or other defects of the anode material. For example, in some embodiments the reversal may be performed at regular intervals that may allow the reversal to be performed for a time period of less than or about 60 minutes between standard operation cycles, and may allow the reversal to be performed for less than or about 50 minutes, less than or about 40 minutes, less than or about 30 minutes, less than or about 20 minutes, less than or about 10 minutes, or less.

In some embodiments the methods may include operations to be performed prior to an idle state of the system. For example, in optional operation 1040, a pump may be operated to pump anolyte from a second compartment section of an anolyte compartment back into a first compartment section of the anolyte compartment where an anode material may be housed. The pumping may drain the anolyte from the second compartment section, and may remove anolyte from fluidly contacting an ionic membrane positioned between the anolyte compartment and the catholyte compartment. In some embodiments the ionic membrane may be maintained free of anolyte except for a residual amount retained within the membrane during the draining or pump out operation. By utilizing replenish modules according to embodiments of the present technology, metal ion replenishment may be facilitated while limiting additive losses and overcoming challenges associated with system idle periods.

In the preceding description, for the purposes of explanation, numerous details have been set forth in order to provide an understanding of various embodiments of the present technology. It will be apparent to one skilled in the art, however, that certain embodiments may be practiced without some of these details, or with additional details. For example, other substrates that may benefit from the wetting techniques described may also be used with the present technology.

Having disclosed several embodiments, it will be recognized by those of skill in the art that various modifications, alternative constructions, and equivalents may be used without departing from the spirit of the embodiments. Additionally, a number of well-known processes and elements have not been described in order to avoid unnecessarily obscuring the present technology. Accordingly, the above description should not be taken as limiting the scope of the technology.

Where a range of values is provided, it is understood that each intervening value, to the smallest fraction of the unit of the lower limit, unless the context clearly dictates otherwise, between the upper and lower limits of that range is also specifically disclosed. Any narrower range between any stated values or unstated intervening values in a stated range and any other stated or intervening value in that stated range is encompassed. The upper and lower limits of those smaller ranges may independently be included or excluded in the range, and each range where either, neither, or both limits are included in the smaller ranges is also encompassed within the technology, subject to any specifically excluded limit in the stated range. Where the stated range includes one or both of the limits, ranges excluding either or both of those included limits are also included. Where multiple values are provided in a list, any range encompassing or based on any of those values is similarly specifically disclosed.

As used herein and in the appended claims, the singular forms "a", "an", and "the" include plural references unless the context clearly dictates otherwise. Thus, for example, reference to "a material" includes a plurality of such materials, and reference to "the channel" includes reference to one or more channels and equivalents thereof known to those skilled in the art, and so forth.

Also, the words "comprise(s)", "comprising", "contain(s)", "containing", "include(s)", and "including", when used in this specification and in the following claims, are intended to specify the presence of stated features, integers, components, or operations, but they do not preclude the presence or addition of one or more other features, integers, components, operations, acts, or groups.

What is claimed is:

1. An electroplating system comprising:

an electroplating chamber; and a replenish assembly fluidly coupled with the electroplating chamber, the replenish assembly comprising:

an anolyte compartment housing anode material, the anolyte compartment having a first compartment section in which the anode material is housed and a second compartment section separated from the first compartment section by a divider, wherein the divider fluidly separates the first compartment section from the second compartment section, a second compartment fluidly coupled with the electroplating chamber and electrically coupled with the anolyte compartment, wherein the second compartment includes a catholyte, and a third compartment electrically coupled with the second compartment, the third compartment comprising an inert cathode.

2. The electroplating system of claim 1, further comprising:

a voltage source coupling the anode material with the inert cathode.

3. The electroplating system of claim 1, wherein the third compartment includes a thiefolyte.

4. The electroplating system of claim 3, wherein the third compartment is fluidly coupled with the electroplating chamber to deliver thiefolyte between the third compartment and the electroplating chamber, and wherein the second compartment is fluidly coupled with the electroplating chamber.

5. The electroplating system of claim 1, further comprising:

a first ionic membrane positioned between the second compartment section of the anolyte compartment and the second compartment; and a second ionic membrane positioned between the second compartment and the third compartment.

6. The electroplating system of claim 5, wherein the second ionic membrane is a monovalent membrane.

7. The electroplating system of claim 1, further comprising:

a pump fluidly coupled between the first compartment section of the anolyte compartment and the second compartment section of the anolyte compartment.

8. The electroplating system of claim 7, wherein the pump is operable in a first setting to flow anolyte from the first compartment section of the anolyte compartment to the second compartment section of the anolyte compartment.

9. The electroplating system of claim 8, wherein a fluid path is defined about the divider so that anolyte flows from the second compartment section of the anolyte compartment to the first compartment section of the anolyte compartment when the pump is operating in the first setting.

10. The electroplating system of claim 8, wherein the pump is operable in a second setting to fully drain the anolyte from the second compartment section of the anolyte compartment.

11. The electroplating system of claim 1, further comprising:

an insert seated in the second compartment, the insert defining at least one fluid channel along the insert.

12. The electroplating system of claim 1, further comprising:

an anode material compartment disposed within the first compartment section of the anolyte compartment, the anode material compartment housing the anode material.

13. The electroplating system of claim 1, wherein the divider is an ionic membrane.

14. A method of operating an electroplating system, the method comprising:

driving a voltage through a replenish assembly, the replenish assembly comprising:

an anolyte compartment housing anode material, the anolyte compartment having a first compartment section in which the anode material is housed and a second compartment section separated from the first compartment section by a divider, wherein the divider fluidly separates the first compartment section from the second compartment section, a second compartment fluidly coupled with an electroplating chamber and electrically coupled with the anolyte compartment, wherein the second compartment includes a catholyte, and a third compartment electrically coupled with the second compartment, the third compartment comprising an inert cathode, wherein the voltage is driven from the anode material to the inert cathode through the first compartment section of the anolyte compartment, the second compartment section of the anolyte compartment, the second compartment, and the third compartment; and providing ions of the anode material to the catholyte flowing through the second compartment.

15. The method of operating an electroplating system of claim 14, further comprising:

reversing the voltage between the anode material and the inert cathode; and removing plated anode material from the inert cathode.

16. The method of operating an electroplating system of claim 14, further comprising:

pumping an anolyte from the second compartment section of the anolyte compartment to the first compartment section of the anolyte compartment to drain the second compartment section of the first compartment.

17. The method of operating an electroplating system of claim 16, wherein the replenish assembly further comprises:

a first ionic membrane positioned between the second compartment section of the anolyte compartment and the second compartment; and a second ionic membrane positioned between the second compartment and the third compartment.

18. The method of operating an electroplating system of claim 17, wherein the pumping maintains the first ionic membrane in fluid contact only with the catholyte.

19. An electroplating system comprising:

an electroplating chamber; and a replenish assembly fluidly coupled with the electroplating chamber, the replenish assembly comprising:

a first compartment housing anode material and an anolyte, the first compartment having a first compartment section in which the anode material is housed and a second compartment section separated from the first compartment section by a divider, wherein a fluid circuit is defined between the first compartment section and the second compartment section, a second compartment fluidly coupled with the electroplating chamber and electrically coupled with the first compartment, wherein the second compartment contains catholyte, a first ionic membrane positioned between the second compartment section of the first compartment and the second compartment, a third compartment electrically coupled with the second compartment, the third compartment comprising an inert cathode, wherein the third compartment comprises an acid thiefolyte, and a second ionic membrane positioned between the second compartment and the third compartment.

20. The electroplating system of claim 19, wherein the divider is a third ionic membrane.

* * * * *